US009567654B2

(12) United States Patent
Govindhakannan

(10) Patent No.: US 9,567,654 B2
(45) Date of Patent: Feb. 14, 2017

(54) BINDER FOR METALLURGICAL COKE AND A PROCESS FOR MAKING SAME

(71) Applicant: UOP LLC, Des Plaines, IL (US)

(72) Inventor: Jagannathan Govindhakannan, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 114 days.

(21) Appl. No.: 14/312,952

(22) Filed: Jun. 24, 2014

(65) Prior Publication Data

US 2015/0368745 A1 Dec. 24, 2015

(51) Int. Cl.

| | |
|---|---|
| ***C22B 1/245*** | (2006.01) |
| ***C21B 5/00*** | (2006.01) |
| ***C10B 57/06*** | (2006.01) |
| ***C10B 57/04*** | (2006.01) |
| ***C10C 3/08*** | (2006.01) |
| ***C10C 3/00*** | (2006.01) |

(52) U.S. Cl.

CPC ..... *C22B 1/245* (2013.01); *C10B 57/04* (2013.01); *C10B 57/06* (2013.01); *C10C 3/002* (2013.01); *C10C 3/08* (2013.01); *C21B 5/007* (2013.01)

(58) Field of Classification Search

CPC ..... C10B 57/06; C10B 57/04; C10C 3/002; C10C 3/08; C22B 1/245; C21B 5/007

See application file for complete search history.

(56) References Cited

U.S. PATENT DOCUMENTS 4,119,409 A 10/1978 Aoki et al.
4,178,215 A 12/1979 Kiritani et al.
4,234,387 A * 11/1980 Nandi ..... C10B 57/06 201/23
4,243,488 A 1/1981 Sugimura et al.
4,314,898 A 2/1982 Nakako et al.
4,318,779 A 3/1982 Tsuyuguchi et al.
4,663,021 A * 5/1987 Arai ..... C10C 3/002 208/106

(Continued)

FOREIGN PATENT DOCUMENTS

AU 519858 B 12/1981
GB 96435 A * 7/1964

(Continued)

OTHER PUBLICATIONS

Benk, Ayse, "Utilisation of the binders prepared from coal tar pitch and phenolic resins . . . " Fuel Processing Technology, Sep. 2010), pp. 1152-1161, v91-n9.

(Continued)

*Primary Examiner* — George Wyszomierski
*Assistant Examiner* — Tima M McGurthry Banks

(57) ABSTRACT

A binder for making metallurgical coke and a process for making the binder. The binder is thermally hydrocracked pitch which has been de-ashed. The binder may be mixed with low rank bituminous coal, heated to make coke which is acceptable as a metallurgical coke. The thermally hydrocracked pitch may be de-ashed by mixing with a solvent, and separating the insoluble portions from the soluble portions using a centrifuge. The soluble portions may be separated from the solvent, for example, in a fractionating section, and used as the binder with poor coking coal to make metallurgical coke.

9 Claims, 1 Drawing Sheet

(56) References Cited

U.S. PATENT DOCUMENTS

| | | | | |
|---|---|---|---|---|
| 2010/0243518 | A1* | 9/2010 | Zimmerman | C10G 67/049 208/45 |
| 2011/0284424 | A1* | 11/2011 | Nakamura | C10C 3/08 208/22 |

FOREIGN PATENT DOCUMENTS

| | | | | |
|---|---|---|---|---|
| GB | 963435 | A * | 7/1964 | C10B 53/08 |
| JP | 4239093 | A | 8/1992 | |
| JP | 2001115168 | A | 4/2001 | |
| JP | 2005213462 | A | 8/2005 | |

OTHER PUBLICATIONS

Benk et al., "Investigation of resole, novalac and coal tar pitch blended binder . . . " Fuel Processing Technology, Mar. 2011, pp. 631-638, v92-n3.

Benk et al., "Molasses and air blown coal tar pitch binders for the production . . . " Fuel Processing Technology, May 2011, pp. 1078-1086, v92-n5.

Swietlik et al., "Modification of coking behaviour of coal blends by plasticizing additives," Journal of Analytical and Applied Pyrolysis, Sep. 1999, pp. 15-31, v52-1.

Mochida et al., "Carbonization and liquid-crystal (mesophase) development . . . " Fuel, Nov. 1979, pp. 797-802, v58-i11.

Li et al., "Cleaning coal for preparing metallurgic coke under moderate operating condition," Journal of Dalian University of Technology, Nov. 1996, pp. 672-676, v36-n6.

* cited by examiner

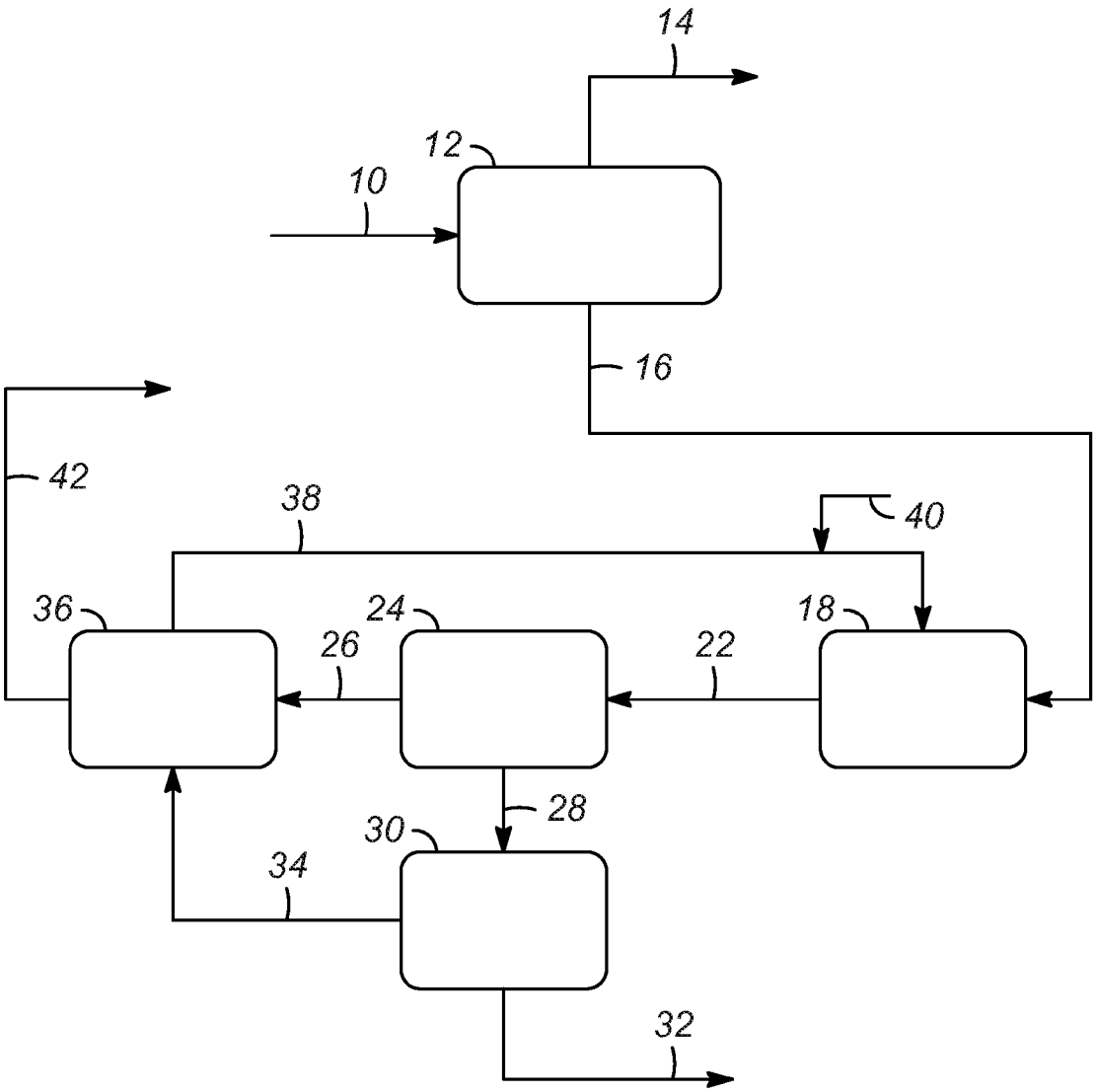
14
12
10
16
42
38
40
36
24
18
26
22
28
30
34
32

BINDER FOR METALLURGICAL COKE AND A PROCESS FOR MAKING SAME

FIELD OF THE INVENTION

This invention relates generally to metallurgical coke, and more specifically, to a thermally hydrocracked pitch based binder for making metallurgical coke.

BACKGROUND OF THE INVENTION

Metallurgical coke has a variety of uses. For example, metallurgical coke can be used for friction materials, for conductive flooring, for foundry coatings, for corrosion materials, for foundry carbon raiser, as a reducing agent, in drilling applications, as ceramic packing media, and for heat-treatment, for oxygen exclusion and electrolytic processes. Metallurgical coke can be also used as a filler coke for poly-granular carbon products.

However, the majority of metallurgical coke is used as a fuel, as well as a reducing agent, for producing iron and steel. More specifically, metallurgical coke is added to iron ore in a blast furnace to produce pig iron which can be processed into other products.

In order to make metallurgical coke, coal is heated in the absence of air, and the coal will soften, plasticize, and then re-solidify into coke. More specifically, coal is fed into coke ovens and subjected to oxygen-free pyrolysis, and heated to approximately 1100° C. This melts the coal and drives off any volatile compounds and impurities to leave pure carbon. The purified, hot, liquefied carbon solidifies into lumps called coke that, for example, can be fed into a blast furnace along with iron ore and limestone to produce pig iron that is further processed to produce steel and steel alloys.

In order to be acceptable as metallurgical coke, the resultant coke must have sufficient stability to support the temperatures, and physical and chemical processes in the blast furnace. Thus, the characteristics and qualities of the coal used to make the coke are important in determining if the coal can be used to make metallurgical coke.

Coal is typically divided into four categories (or ranks): anthracite; bituminous; sub-bituminous; and, lignite. Each type of coal has different sets of physical properties that are based upon a variety of factors. Three of the more relevant factors that impact the coal's physical properties are the moisture, volatile content, and carbon content. Additionally, the levels of sulfur and ash in coal are typically used in determining if the coal is good coking coal. For example, a good coking coal may have a moisture content between 2-15%, a volatile content between 32-36%, a carbon content between 45-85%, and ash content between 3-12% and a sulfur content between 0.7-4%.

Additionally, the Crucible Swelling Number (CSN) (also referred to as Free Swelling Index (FSI)) is one qualitative measurement that can be used to evaluate the properties of the coal. A coal with a low CSN, for example between 0 to 2, is believed to be unsuitable for making metallurgical coke. Additionally, a coal with a high CSN, for example 8 or 9, is also believed to be unsuitable for making metallurgical coke.

If the coal meets the appropriate standards and thus, has acceptable physical characteristics as well as low enough levels of impurities), it is considered "good coking coal" (or "metallurgical coal"). On the other hand however, if the coal does meet one or more of the standards for the good coking coal, it is considered "poor coking coal" (or "non-metallurgical coal") and is not used by itself to make metallurgical coke.

Since good coking coal is both rare and expensive in comparison to poor coking coal, efforts have been made to utilize poor coking coal to produce metallurgical coke. One known method for using poor coking coal to produce metallurgical coke involves mixing the poor coking coal with good coking coal. The mixture typically must provide an acceptable base to acid ratio. The base to acid ratio for the coal is defined as the amount of the basic oxides ($Fe_2O_3$, CaO, MgO, $K_2O$, $Na_2O$) divided by the amount of the acidic oxides ($SiO_2$, $Al_2O_3$, $TiO_2$). If the resulting mixture has an acceptable base to acid ratio, it can be used to produce metallurgical coke. However, this method still requires the use of good coking coal, which, again is expensive and rare in comparison to poor coking coal.

Another method of using poor coking coal to produce metallurgical coke involves mixing poor coking coal with one or more binders. The binder(s), together with the poor coking coal, can be heated to make a coke that has the appropriate properties associated with metallurgical coke.

Pitch is a viscoelastic polymer that can be derived from a variety of sources and which has been used as a binder with poor coking coal to make metallurgical coke. Pitch can come from a variety of sources, for example, thermal hydrocracking of petroleum residues, petroleum processing by distillation and solvent de-asphalting, and destructive distillation of coal to name a few. The source of the pitch will impact the pitch components (and the pitch properties).

Thermally hydrocracked pitch is readily abundant and comprises a solid waste product from the various reactions of petroleum residues to produce various desirable products like gasoline, diesel, gas oil and other hydrocarbon materials. Typically, thermally hydrocracked pitch comprises a mixture of coke, spent catalyst, and, some heavy hydrocarbons (i.e., hydrocarbons having 20 or more carbon atoms).

While it has been suggested to use neat (i.e., unaltered) thermally hydrocracked pitch as a binder for making metallurgical coke, thermally hydrocracked pitch contains various chemicals and impurities that are or may be undesirable in metallurgical coke.

It would be desirable to provide a process for making a thermally hydrocracked pitch based binder which can be used with poor coking coal to produce acceptable metallurgical coke.

SUMMARY OF THE INVENTION

It has been discovered that de-ashing the thermally hydrocracked pitch, a binder is produced, which can be used with inexpensive and available poor coking coal to make metallurgical coke.

Accordingly, one embodiment of the invention may be characterized as a process for producing a pitch based binder for metallurgical coke in which a thermally hydrocracked pitch is separated into a liquid phase and a solid phase and, a portion of the liquid phase as a binder is mixed with a poor coking coal to form a metallurgical coke. The solid phase of the thermally hydrocracked pitch may comprise at least one of: coke; spent catalyst; and, heavy hydrocarbons. It is contemplated that the process includes mixing a solvent with the thermally hydrocracked pitch and further contemplated that the liquid phase of the thermally hydrocracked pitch includes solvent. It is also contemplated that the liquid phase is separated into solvent and a de-ashed pitch, wherein the de-ashed pitch is the binder to be mixed with the poor coking coal. The solid phase may be dried to recover a residual solvent. It is further contemplated to recover the solvent separated from the de-ashed pitch and mix a portion of the recovered solvent with thermally hydrocracked pitch. The liquid phase and the solid phase may be separated by a centrifuge. The solvent may be an aromatic solvent.

Another embodiment of the present invention may be characterized as raw materials for metallurgical coke comprising a poor coking coal and, an effective amount of a thermally hydrocracked pitch-based binder. The thermally hydrocracked pitch-based binder is a de-ashed pitch that comprises heavy hydrocarbons. The de-ashed pitch may comprise less than 5.0% sulfur, by weight. The de-ashed pitch may also comprise less than 1.0% ash, by weight. The de-ashed pitch may also comprise less than 1.0% iron, by weight. The de-ashed pitch may also comprise between 20-50% carbon residue, by weight.

In yet another embodiment of the present invention, the invention provides a process for producing a binder to make a metallurgical coke in which a pitch, comprising solids and liquids, from a thermal hydrocracking process is mixed with a solvent, at least a portion of the liquids being soluble in the solvent, the solubilized hydrocarbons are separated from the insoluble portion of the pitch, the soluble portion of the pitch, which is de-ashed pitch, is removed from the solvent, and metallurgical coke can be produced with the de-ashed pitch as a binder. The solvent may be separated from the insoluble portion of the pitch by a drying system (e.g., a paddle dryer). It is further contemplated to recover the solvent from the soluble portion of the pitch and mix the recovered solvent with pitch from a thermal hydrocracking process. The insoluble portion of the pitch separated from the solvent may be dried to form dried solids and a residual solvent may be recovered during the drying. The dried solids comprises at least one of coke and spent catalyst and residual hydrocarbons if any.

Additional objects, embodiments, and details of the invention are set forth in the following detailed description of the invention.

DETAILED DESCRIPTION OF THE DRAWING

The drawing is simplified process diagram in which the FIGURE shows a process according to one or more embodiments of the present invention for making a thermally hydrocracked pitch-based binder to be used to make metallurgical coke.

DETAILED DESCRIPTION OF THE INVENTION

A method has been developed in which a pitch from a thermal hydrocracking process is de-ashed. The de-ashed pitch can be utilized as a binder with poor coking coal to produce metallurgical coke. As used herein "poor coking coal" means coal or a coal blend that has a high level of one or more impurities, unsatisfactory physical properties, or both, and would not typically be used to make metallurgical coke.

It is believed that the de-ashed pitch will be almost devoid of impurities such as nickel and vanadium contaminants, as the contaminants are removed to a ppm level. Furthermore, the de-ashed pitch is expected to provide improved bonding between the coal macerals from poor coking coal. Additionally, it is believed that the de-ashed pitch will provide fluidity, wet the inert coal macerals, and fill the void interstitial spaces of the coal macerals to produce coke acceptable for use as metallurgical coke. Finally, in addition to providing a method for poor coking coal to make metallurgical coke, the processes of the present invention provide a method for refiners to dispose of the thermally hydrocracked pitch (which is a waste product).

An exemplary embodiment of the present invention is shown in the FIGURE which depicts a feed stream 10 being passed into a reaction zone 12 to undergo, in the presence of hydrogen and a catalyst, a thermal hydrocracking process to produce a one or more product streams 14. However, some thermal hydrocracking processes may not utilize a catalyst. These thermal hydrocracking processes are well known to those of ordinary skill in the art.

For example, the thermal hydrocracking process may be a slurry hydrocracking process, such as those disclosed in U.S. Pat. No. 8,691,080 and U.S. Pat. Pub. No. 2014/0102944, both of which are incorporated herein by reference. Generally, in a slurry hydrocracking process, a feed stock is mixed with catalyst to form a slurry. The slurry may be combined with a gas, such as hydrogen, and passed to a heater. Once the gas and slurry mixture has been heated, it can be passed to a reaction zone. Conditions in the reaction zone can include a temperature of about 340 to about 600° C., a hydrogen partial pressure of about 3.5 to about 10.5 MPa, and a space velocity of about 0.1 to about 30 volumes of hydrocarbon feed per hour per reactor or reaction zone volume. The reactor conditions are sufficient to crack at least a portion of the hydrocarbon feed to lower boiling products, such as one or more $C_1$ to $C_4$ products, naphtha, or combinations thereof. The desirable products can be recovered via a distillation, such as a vacuum distillation.

However, a portion of the reaction product, namely pitch, will remain after vacuum distillation. Typically pitch has a boiling point greater than about 500° C. This high boiling material can have a very low value due to high viscosity, portability difficulties, and high levels of undesired components, such as sulfur contaminants and a slurry hydrocracking catalyst used during the cracking of the feedstock. Exemplary catalyst compounds can include a catalytically effective amount of one or more compounds having iron. Particularly, the one or more compounds can include at least one of an iron oxide, an iron sulfate, and an iron carbonate. Other forms of iron can include at least one of an iron sulfide, a pyrrhotite, and a pyrite. The catalyst can also contain materials other than an iron, such as at least one of molybdenum, nickel, and manganese, and/or a salt, an oxide, and/or a mineral thereof. Thus, the pitch compromises a mixture of coke, heavy hydrocarbons, and catalyst. While, for example, the high viscosity of the pitch may be generally undesirable, such may be useful for using the pitch as a binder material.

In contrast to using "neat pitch" (or pitch from the thermal hydrocracking process that is not processed further) as a binder for metallurgical coke, in processes according to the various embodiments of the present invention, the thermally hydrocracked pitch is de-ashed to upgrade the qualities of same and remove various impurities from same.

Accordingly, the thermally hydrocracked pitch 16 from the reaction zone 12 may be passed to a mixing zone 18. The pitch can be stored and used later, or stored and shipped to another location, or it may be directly passed to the mixing zone 18. The timing and method of obtaining the pitch and passing the pitch to the mixing zone 18 are not necessarily important for an understanding or practicing of the present invention.

In the mixing zone 18, the pitch is mixed with a solvent, preferably an aromatic solvent, such as aromatic cycle oils, aromatic naphtha, aromatic diesel, benzene, toluene, xylenes, and mixtures thereof. As will be discussed below, the solvent may be recovered from downstream processing and recycled back to the mixing zone 18. At certain times, make up or fresh solvent may be added (for example at the start of the process). A portion of the thermally hydrocracked pitch, mostly the heavy hydrocarbons, will be soluble in the solvent, while a second portion, the remaining components, will not be soluble.

Accordingly, the mixture of thermally hydrocracked pitch and solvent 22 can be passed to a separation zone 24 to separate the mixture into a liquid phase 26 and a solids phase 28. In a preferred embodiment, the separation zone 24 comprises a centrifuge, and in a most preferred embodiment, the centrifuge is a decanter centrifuge. If a decanter centrifuge is used, the process can be advantageously continuous in which the mixture of pitch and solvent is continuously passed to the separation zone 24 and the liquid phase 26 and the solids phase 28 continuously can be removed.

The liquid phase 26 comprises the solvent and the soluble portions of the thermally hydrocracked pitch. The solids phase 28 comprises the insoluble portions of the thermally hydrocracked pitch, as well as some small amount of solvent. The solids portions 28 may be passed to a drying zone 30 to produce a dried solids 32. The dried solids 32 will include at least one of coke, spent catalyst, and the other impurities from the pitch. The dried solids 32 can be used as a fuel in a cement kiln. A preferred drying zone 30 comprises a paddle dryer which is heated by a hot oil system through the shell. The paddles are also heated. The motion of paddles will move the solids phase and break up the solids phase into clumps for faster drying. A residual solvent 34 may also be recovered from the drying zone 30.

Returning to the separation zone 24, the liquid phase 26 may be passed to a recovery zone 36 to separate the solvent from the remaining portions of the thermally hydrocracked pitch. A vacuum distillation column may be used to separate the solvent and the remaining portions of the thermally hydrocracked pitch in the recovery zone 36. Other separation methods, processes or equipment may also be used. The recovery zone 36 may also receive the residual solvent 34 from the drying zone 30.

As mentioned above, solvent, both recovered from the recovery zone 36 and residual solvent 34, is preferably recycled back via a stream 38 to the mixing zone 18 where it can be mixed with thermally hydrocracked pitch beginning the de-ashing process. If needed, additional solvent, fresh or make up, can be added via a line 40.

Returning to the recovery zone 36, the portion of the thermally hydrocracked pitch that is separated from the solvent comprises de-ashed pitch 42 which mainly comprises the heavy hydrocarbons from the thermally hydrocracked pitch. The de-ashed pitch 42 can be utilized as a binder with poor coking coal for making metallurgical coke.

Preferably, an effective amount of the de-ashed thermally hydrocracked pitch-based binder is mixed with the poor coking coal. It is contemplated that the effective amount is approximately 10% by weight, or between 10 to 20% by weight. This amount may vary based upon the qualities and characteristics of the poor coking coal used.

In order to demonstrate the principals of the present invention, a portion of thermally hydrocracked pitch was subjected to a de-ashing process according to the present invention.

A sample of unprocessed pitch was obtained from thermal hydrocracking of a Russian Export Blend VTB. The unprocessed pitch was mixed with a light cycle oil (LCO) fraction with 3:1 solvent to pitch ratio by weight. The mixture was processed in a laboratory batch filtration apparatus with 1-2 micron filter media. The filter housing was heated and the filtrate temperatures ranged from 50-80° C. A batch laboratory distillation apparatus was used to remove the light cycle oil present in the filtrate. The remaining filtrate after the light cycle oil was removed comprises the de-ashed pitch. A comparison of the properties of de-ashed thermally hydrocracked pitch and the neat pitch is shown in TABLE 1, below.

TABLE 1

| Property | Method | Pitch | De-ashed pitch |
|---|---|---|---|
| C, wt % | ASTM D5291 | 80.4 | 86.2 |
| H, wt % | ASTM D5291 | 6.81 | 7.75 |
| N, wt % | ASTM D5291 | 0.99 | 0.773 |
| S, wt % | UOP 864 | 5.6 | 2.35 |
| Fe, wt % | UOP 714 ICP | 4.7 | 0.0068 |
| Ni, wt % | UOP 714 ICP | 0.035 | 0.006 |
| V, wt % | UOP 714 ICP | 0.122 | 0.0099 |
| Ash, wt % | ASTM D482 | 6.84 | 0.032 |
| H/C atomic ratio | Calc. | 1.02 | 1.08 |
| Toluene insolubles, wt % | UOP 614M | 20.7 | 7.96 |
| Carbon residue, wt % | ASTM D4530 | 61.5 | 50.8 |

As will be appreciated, by subjecting the thermally hydrocracked pitch to a de-ashing process according to the present invention, the levels of various impurities such as sulfur and iron are lowered substantially. Furthermore, the desired properties, for example carbon residue, are not lowered excessively or are maintained relatively close to their original level or value.

Therefore, it is believed that the de-ashed pitch can be utilized as a binder with poor coking coal to make metallurgical coke, allowing for the production of metallurgical coke from abundant and less expensive coal. In addition to allowing for the use of poor coking coal, the present invention provides a use for thermally hydrocracked pitch, another abundant product.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for producing a pitch based binder for metallurgical coke comprising:

mixing a solvent with a thermally hydrocracked pitch;

separating the thermally hydrocracked pitch into a liquid phase and a solid phase, wherein the liquid phase includes solvent;

separating the liquid phase into solvent and a de-ashed pitch;

drying the solid phase to recover a residual solvent; and mixing the de-ashed pitch as a binder with a poor coking coal to form a metallurgical coke.

2. The method of claim 1 wherein the solid phase comprises at least one of: coke; catalyst; and, heavy hydrocarbons.

3. The method of claim 1 further comprising:

recovering the solvent separated from the de-ashed pitch; and, mixing a portion of the recovered solvent with thermally hydrocracked pitch.

4. The method of claim 1 wherein the solvent comprises an aromatic solvent.

5. The method of claim 4, wherein the liquid phase and the solid phase are separated by a centrifuge.

6. A process for producing a binder to make a metallurgical coke comprising:

mixing a pitch from a thermal cracking process with a solvent, the pitch comprising solids and liquids, at least a portion of the liquids being soluble in the solvent;

separating the solvent from an insoluble portion of the pitch, wherein the solvent is separated from the insoluble portion of the pitch by a centrifuge;

removing the soluble portion of the pitch from the solvent, wherein the soluble portion of the pitch removed from the solvent comprises a de-ashed pitch; and producing metallurgical coke by using the de-ashed pitch as a binder.

7. The process of claim 6 further comprising:

recovering the solvent after the soluble portion of the pitch has been removed; and, mixing the recovered solvent with pitch from a thermal hydrocracking process.

8. The process of claim 7 further comprising:

drying the insoluble portion of the pitch separated from the solvent to form dried solids; and, recovering a residual solvent during the drying.

9. The process of claim 8 wherein the dried solids comprises at least one of coke, catalyst and heavy hydrocarbons.

* * * * *